US010709939B2

(12) United States Patent
Simansky

(10) Patent No.: US 10,709,939 B2
(45) Date of Patent: Jul. 14, 2020

(54) GOLF BALL RETRIEVER

(71) Applicant: John Anthony Simansky, Bel Air, MD (US)

(72) Inventor: John Anthony Simansky, Bel Air, MD (US)

( * ) Notice: Subject to any disclaimer, the term of this patent is extended or adjusted under 35 U.S.C. 154(b) by 0 days.

(21) Appl. No.: 16/557,072

(22) Filed: Aug. 30, 2019

(65) Prior Publication Data

US 2020/0070014 A1 Mar. 5, 2020

Related U.S. Application Data

(60) Provisional application No. 62/725,224, filed on Aug. 30, 2018.

(51) Int. Cl.
*A63B 47/02* (2006.01)

(52) U.S. Cl.
CPC ..... *A63B 47/02* (2013.01)

(58) Field of Classification Search
CPC ..... A63B 47/02; A63B 47/025; A63B 53/14; A01D 51/002; A47F 13/06
USPC ..... 294/19.2; 473/286, 460
See application file for complete search history.

(56) References Cited

U.S. PATENT DOCUMENTS 2,738,214 A * 3/1956 Zimmers ..... A63B 47/02 294/19.2
4,322,939 A * 4/1982 McDonald ..... A01D 51/002 294/19.2
5,277,466 A * 1/1994 Wall ..... A63B 47/02 294/19.2
5,326,145 A * 7/1994 Lee ..... A63B 47/02 294/19.2
5,328,220 A 7/1994 McPherson
5,575,519 A 11/1996 Mansbridge
5,823,591 A 10/1998 Rubinstein
5,954,376 A 9/1999 Ader
5,997,062 A * 12/1999 Schwartz ..... A63B 47/02 294/19.2
6,454,331 B1 * 9/2002 Ahlenius ..... A63B 47/02 294/19.2
6,485,075 B1 11/2002 McClain
D475,112 S 5/2003 Adzick
7,938,465 B2 5/2011 Spacone et al.
10,213,657 B1 2/2019 Klevana et al.
2009/0033109 A1 * 2/2009 Lipcznski ..... A63B 47/02 294/19.2
2014/0035303 A1 2/2014 Nihra et al.

* cited by examiner

*Primary Examiner* — Stephen A Vu

(57) ABSTRACT

A device for retrieving a golf ball that is not easily accessible in ponds, in high grass, in bushes, in rocky terrain or in other places that are hard to reach. The device comprises a retriever head that is attached to a telescoping handle. The retriever head comprises an elongated rigid head with no moving parts, with a large opening at the bottom of the front of the retriever. The retriever widens along the sides to form a pocket at the tapered end at the top of the retriever that is used to entrap a golf ball. The outside of the tapered end of the retriever can be used to retrieve a golf ball by scooping it onto the side of the retriever. The rounded point at the tapered end of the retriever can be used to dislodge or reposition a golf ball so that it can be easily retrieved.

20 Claims, 3 Drawing Sheets

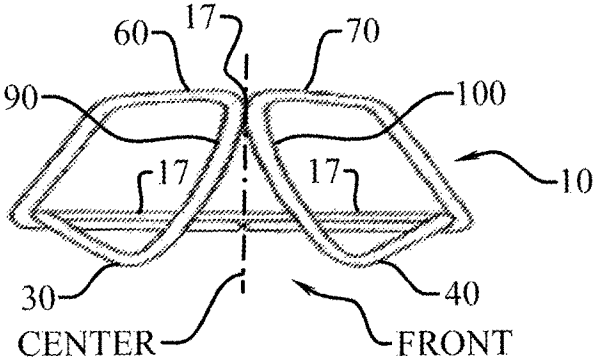
Fig. 1
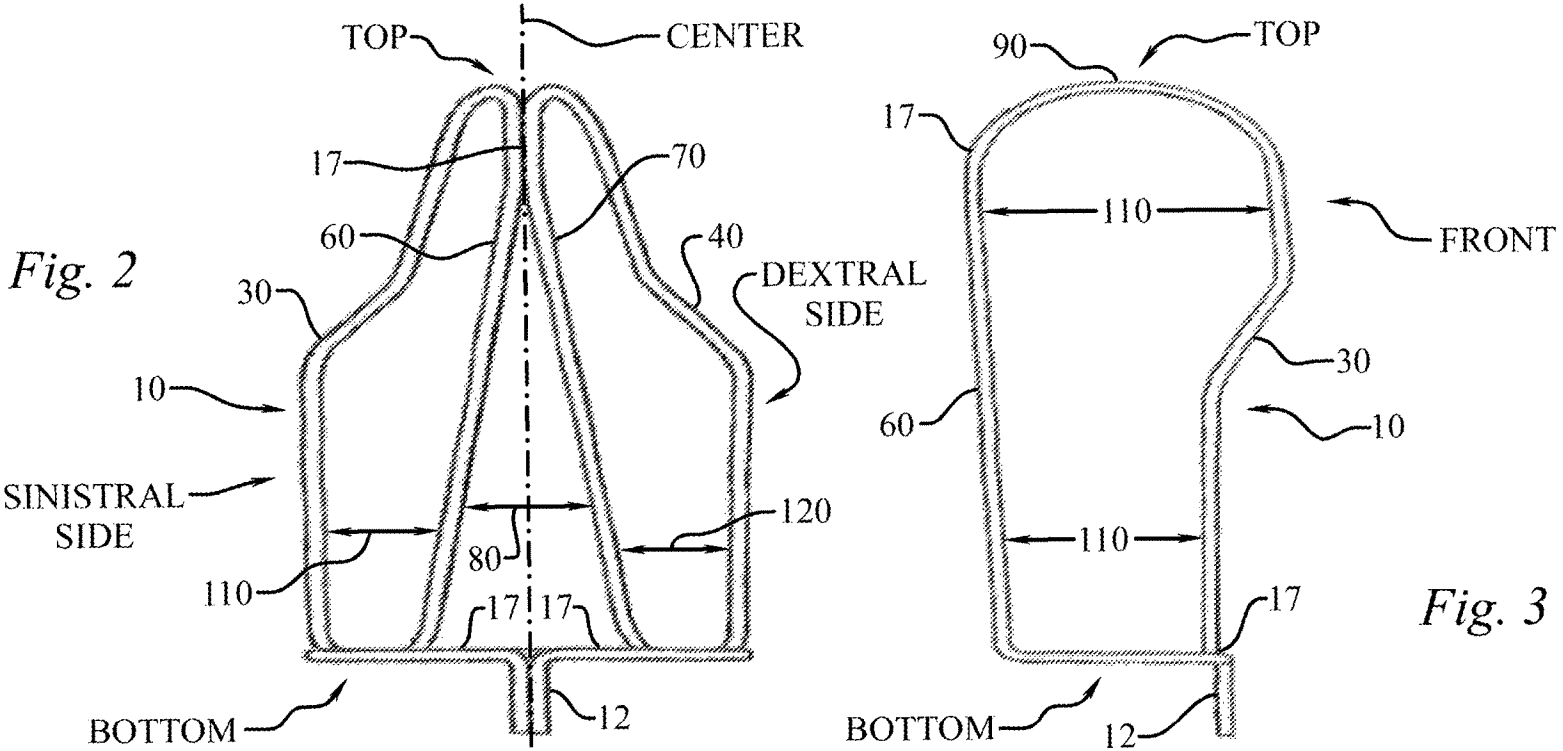
Fig. 2
Fig. 3

GOLF BALL RETRIEVER

FIELD OF THE INVENTION

The invention relates generally to devices for retrieving golf balls.

BACKGROUND OF THE INVENTION

Golf ball retrievers are used by many golfers to retriever golf balls that are not easily accessible in ponds, in high grass, in bushes, in rocky terrain or in other places that are hard to reach. While there is a wide variety of designs for golf ball retrievers, the majority of the retriever heads are not much larger than a golf ball itself and can only retrieve a ball using a single retrieval method, making them inefficient and hard to use.

There is a need for a golf ball retriever that has a larger retriever head, that has more than a single retrieval method and that can also be used to dislodge or reposition a golf ball so that it can be retrieved, while being small enough to easily fit into the club section of a golf bag and small enough to be covered by a standard sized club head cover.

BRIEF SUMMARY OF THE INVENTION

The present invention is a device for retrieving a golf ball that is not easily accessible in ponds, in high grass, in bushes, in rocky terrain or in other places that are hard to reach. The device comprises a golf ball retrieving head, that consists of a rigid frame, wherein the rigid frame consists of an elongated head, that has symmetrical mirror image sides, with a perpendicular extension at the center of the bottom of the front of retriever head, that is attached to a telescoping handle.

The front of the retriever has a somewhat rectangular opening at the bottom, that extends to the center, from which it tapers to a rounded point at the top. The back of the retriever is wide at the bottom and uniformly tapers to a rounded point at the top. The sides of the retriever generally widen from the bottom to form a semi circular end at the top of the retriever, the combination of both sides at the top of the retriever head forms a pocket, wherein a golf ball can be entrapped.

The openings in the bottom, the back, the sides and at the top of the front of the retriever are smaller than the diameter of a golf ball and the opening at the bottom of the front of the retriever is significantly larger than a golf ball.

One advantage of the present invention is its ease of use, the large opening at the bottom of the front of the retriever allows for a larger margin of error when retrieving a golf ball.

Another advantage of the present invention is its versatility, it offers two methods to retrieve a golf ball and the rounded point at the top of the retriever can be used to dislodge or reposition a golf ball so that it can be easily retrieved in one of the two retrieval methods.

A further advantage of the present invention is its simple construction, with no moving parts, which makes it durable and economical to manufacture.

A still further advantage of the present invention is that it is small enough to be easily stored in the club section of a golf bag and small enough to be covered by a standard sized club head cover.

These and other advantages will become apparent from a consideration of the following detailed description and drawings.

BRIEF DESCRIPTION OF THE DRAWINGS

FIG. 1 is a top view of the golf ball retriever head. The front of the retriever head is at the bottom of the figure.

FIG. 2 is a front view of the golf ball retriever head.

FIG. 3 is a side view of the golf ball retriever head. The front of the retriever head is on the right side of the figure.

DETAILED DESCRIPTION OF THE INVENTION

The present invention is a device for retrieving a golf ball 13 that is not easily accessible in ponds, in high grass, in bushes, in rocky terrain or in other places that are hard to reach.

The invention is a golf ball retriever, that can retrieve a golf ball 13 in two different ways, a primary retrieval method and a secondary retrieval method. A golf ball retriever that can be easily pushed into and/or through mud, high grass and bushes without getting stuck. The rounded point at the top of the retriever head 10 can be used to dislodge or reposition a golf ball 13 so that it can be easily retrieved in one of the two different retrieval methods.

Figure 7:
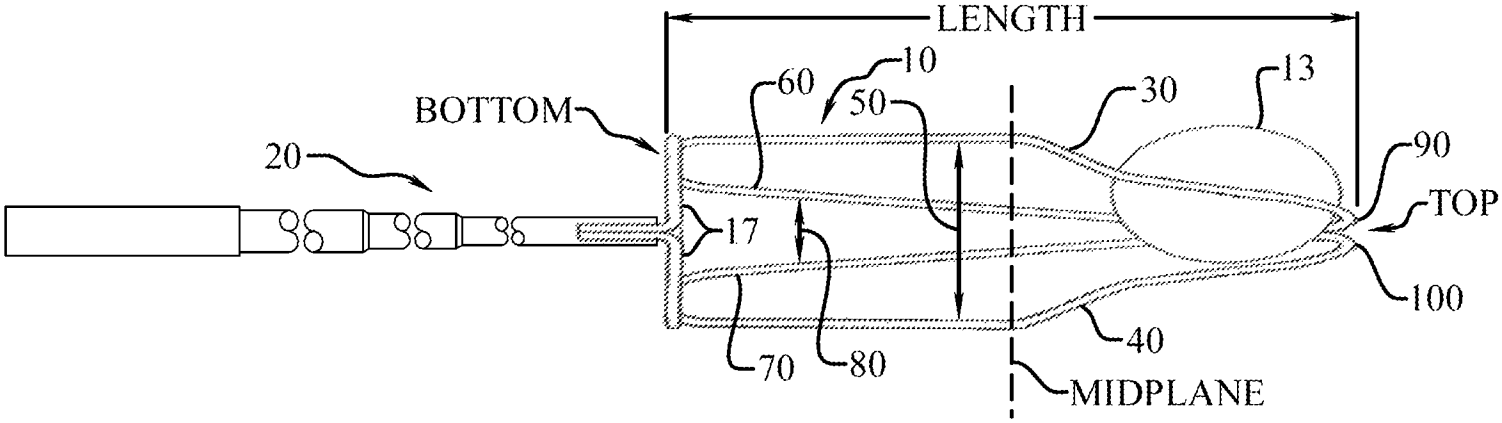
FIG. 7 is a front view of the golf ball retriever head. This figure shows a golf ball cradled on the side of the top of the retriever head.

The device comprises a golf ball retrieving head, 10 that consists of a rigid frame, wherein the rigid frame consists of an elongated head, that has symmetrical mirror image sides, along the top view as shown in FIG. 1 and along the front view as shown in FIG. 2, with a perpendicular extension 12 at the center of the bottom of the retriever head 10, that is attached to a telescoping handle 20, as seen in FIG. 7. The head has a head length, a sinistral side, a dextral side, a front, a back, a top, and a bottom. The rigid frame may include a front sinistral frame member 30 and a front dextral frame member 40, a front frame separation distance 50 measured between the front sinistral frame member 30 and the front dextral frame member 40, as seen in FIG. 7. Similarly, seen in FIGS. 2 and 7, the rigid frame may include a rear sinistral frame member 60 and a rear dextral frame member 70, a rear frame separation distance 80 measured between the rear sinistral frame member 60 and the rear dextral frame member 70. Additionally, as seen in FIGS. 1, 3, and 7, the rigid frame may include a top sinistral frame member 90 connecting the front sinistral frame member 30 and the rear sinistral frame member 60, and a top dextral frame member 100 connecting the front dextral frame member 40 and the rear dextral frame member 70, wherein the top sinistral frame member 90 and the top dextral frame member 100 prevent the golf ball from exiting the top of the retrieving head.

FIG. 1, FIG. 2 and FIG. 3 show a top view, a front view and a side view of the retriever head, 10 respectively. The front of the retriever head 10 is at the bottom of the top view of the retriever head 10 as shown in FIG. 1 and on the right side of the side view of the retriever head 10 as shown in FIG. 3.

Figure 6:
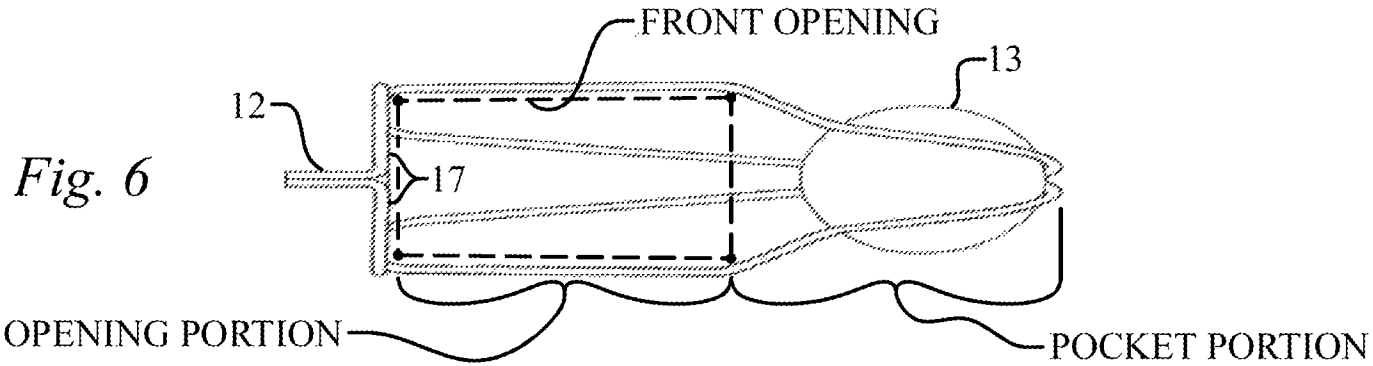
FIG. 6 is a front view of the golf ball retriever head. This figure shows a golf ball entrapped in the pocket at the top of the retriever head.

The front of the retriever head 10 has a somewhat rectangular opening at the bottom, referred to as the opening portion in FIG. 6, that extends to a midplane seen in FIG. 7, which passes through a midpoint of the head length, from which it tapers to a rounded point at the top as shown in FIG. 2. The front frame separation distance 50 is (a) greater than a golf ball diameter over a portion of the head length thereby defining the opening portion and enabling the golf ball to enter the rigid frame, and (b) less than a golf ball diameter over a portion of the head length thereby defining a pocket portion in which the golf ball cannot exit the rigid frame.

The back of the retriever head 10 is wide at the bottom and tapers uniformly to a rounded point at the top as shown in FIG. 2.

The sides of the retriever head 10 generally widen from the bottom to form a semi-circular end at the top of the retriever head 10, where the top sinistral frame member 90 connects the front sinistral frame member 30 and the rear sinistral frame member 60, and where the top dextral frame member 100 connects the front dextral frame member 40 and the rear dextral frame member 70 as shown in FIG. 1 and FIG. 3.

Figure 4:
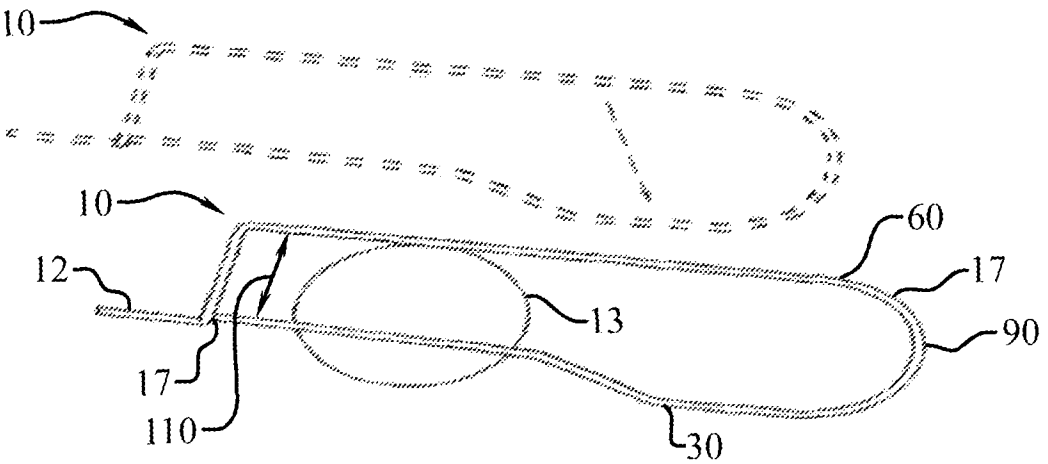
FIG. 4 is a side view of the golf ball retriever head that shows the first step of the primary retrieval method. The broken line figure shows the golf ball retriever head positioned over a golf ball before retrieval, with a broken line arrow that shows the direction of movement to position the retriever head on the golf ball for retrieval as shown in the solid line figure.

The openings in the bottom, the back, the sides and at the top of the front of the retriever head 10 are smaller than the diameter of a golf ball 13 which creates an area within the retriever head 10, identified as the pocket portion in FIG. 6, to confine and entrap a golf ball 13. Thus, as seen in FIGS. 2, 3, and 4, the rigid frame may have a sinistral frame separation distance 110 between the front sinistral frame member 30 and the rear sinistral frame member 60, wherein the sinistral frame separation distance 110 is less than the golf ball diameter throughout the head length. Similarly, the rigid frame may also have a dextral frame separation distance between the front dextral frame member and the rear dextral frame member, wherein the dextral frame separation distance is less than the golf ball diameter throughout the head length. Additionally, the rear frame separation distance 80, seen in FIGS. 2 and 7, is less than the golf ball diameter throughout the head length.

The somewhat rectangular opening at the bottom of the front of the retriever head 10 as shown in FIG. 7 and labeled as the front opening, is significantly larger than a golf ball 13, which makes it easier to align, entrap and retrieve a golf ball 13.

Figure 5:
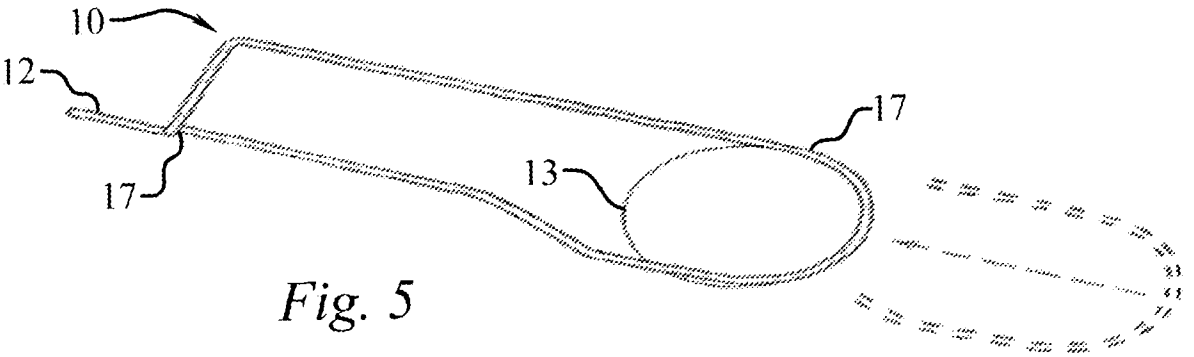
FIG. 5 is a side view of the golf ball retriever head that shows the second step of the primary retrieval method. The partial broken line image shows the position of the top of the retriever head, which represents the position of the top of the retriever head as shown in the solid line image in FIG. 4, with a broken line arrow that shows the direction of movement to entrap a golf ball in the pocket at the top of the retriever head as shown in the solid line figure in FIG. 5.

FIG. 4 and FIG. 5 together, show a side view of the primary method for retrieving a golf ball 13. FIG. 4 shows the first step in the primary retrieval method and FIG. 5 shows the second step in the primary retrieval method.

The primary method for retrieving a golf ball 13 is accomplished by positioning the opening at the bottom of the front of the retriever head 10 over a golf ball 13 as shown by the broken line figure in FIG. 4 and lowering it onto the golf ball 13 as shown by the solid line figure in FIG. 4, the retriever head is then pulled towards the person retrieving the golf ball 13 as shown by the partial broken line figure in FIG. 5 and entrapped in the pocket at the top of the retriever head 10 as shown by the solid line figure in FIG. 5. This method of retrieval does not require the retriever head 10 to rotated in order to entrap the golf ball 13 in the pocket at the top of the retriever head. 10. The golf ball 13 can be removed from the retriever head 10 by hand or by raising the retriever head 10 above horizontal level and flipping the golf ball retriever away from the person retrieving the golf ball 13.

FIG. 6 shows the front view of the retriever head 10 with a golf ball 13 entrapped in the pocket at the top of the retriever head 10 using the primary retrieval method.

The secondary method for retrieving a golf ball 13 is accomplished by positioning either side of the retriever head 10, next to a golf ball 13, with the front of the retriever head 10 facing down and scooping the golf ball 13, while rotating the retriever head 10 so that the golf ball 13 is cradled on the outside of the top of retriever head 10 as shown in FIG. 7. The golf ball 13 can be removed from the retriever head 10 by hand or by inverting the retriever head 10.

The retriever head 10 can be made by forming a single piece of rigid wire, on a jig, by hand or by mechanical means. Once the rigid frame is formed, it is secured together by welds or by metal bands that are crimped in place, at three points 17, one near the top of the back of the retriever head 10 and two at the bottom of the front of the retriever head 10 on both sides of the perpendicular extension 12. After the retriever head 10 is made it can be covered with a protective coating.

The exemplary embodiments of the invention described above in detail, are subject to different variations in size, materials and methods of manufacture, are explanatory and illustrative in nature only and should not be construed as limiting the scope of the invention. Therefore, the scope of the invention should be determined by the following claims and all equivalents.

The invention claimed is:

1. A golf ball retriever for releasably capturing a golf ball, comprising:

a telescoping handle;

a golf ball retrieving head that comprises a rigid frame, wherein the rigid frame consists of an elongated head that has a head length, a sinistral sides, a dextral side, a front, a back, a top, a bottom, and an extension connected to the telescoping handle;

wherein the rigid frame includes:

a front sinistral frame member and a front dextral frame member extending from the bottom to the top of the retrieving head, a front frame separation distance measured between the front sinistral frame member and the front dextral frame member, wherein the front frame separation distance is (a) greater than a golf ball diameter over a portion of the head length thereby defining an opening portion enabling the golf ball to enter the rigid frame, and (b) less than a golf ball diameter over a portion of the head length thereby defining a pocket portion in which the golf ball cannot exit the rigid frame;

a rear sinistral frame member and a rear dextral frame member extending from the bottom to the top of the retrieving head, a rear frame separation distance measured between the rear sinistral frame member and the rear dextral frame member, wherein the rear frame separation distance is less than the golf ball diameter throughout the head length;

a top sinistral frame member located at the top of the retrieving head and connecting the front sinistral frame member and the rear sinistral frame member, and a top dextral frame member located at the top of the retrieving head and connecting the front dextral frame member and the rear dextral frame member, wherein the top sinistral frame member and the top dextral frame member prevent the golf ball from exiting the top of the retrieving head;

a sinistral frame separation distance between the front sinistral frame member and the rear sinistral frame member, wherein the sinistral frame separation distance is less than the golf ball diameter throughout the head length; and a dextral frame separation distance between the front dextral frame member and the rear dextral frame member, wherein the dextral frame separation distance is less than the golf ball diameter throughout the head length.

2. The golf ball retriever of claim 1, wherein said the golf ball retrieving head is symmetrical about a retriever plane containing a longitudinal axis of the telescoping handle, and the opening portion extends throughout at least half of the head length.

3. The golf ball retriever of claim 1, wherein the front frame separation distance is not constant throughout the head length, the rear frame separation distance is not constant throughout the head length, at least a portion of the front sinistral frame member is angled toward the front dextral frame member as it extends toward the top within the pocket portion, and at least a portion of the front dextral frame member is angled toward the front sinistral frame member as it extends toward the top within the pocket portion.

4. The golf ball retriever of claim 1, wherein the top sinistral frame member and the top dextral frame member are formed in the shape of a semicircle having a diameter less than the golf ball diameter.

5. The golf ball retriever of claim 4, wherein the rear sinistral frame member contacts the rear dextral frame member within the pocket portion.

6. The golf ball retriever of claim 1, wherein the sinistral frame separation distance varies over a portion of the head length, and the dextral frame separation distance varies over a portion of the head length.

7. The golf ball retriever of claim 6, wherein the sinistral frame separation distance varies within the pocket portion, and the dextral frame separation distance varies within the pocket portion.

8. The golf ball retriever of claim 7, wherein the front frame separation distance varies within the pocket portion, and the rear frame separation distance varies within the pocket portion.

9. The golf ball retriever of claim 8, wherein the front frame separation distance decreases continuously within the pocket portion, and the rear frame separation distance decreases continuously within the pocket portion.

10. The golf ball retriever of claim 9, wherein the sinistral frame separation distance varies within the opening portion, and the dextral frame separation distance varies within the opening portion.

11. The golf ball retriever of claim 1, wherein a front plane containing a portion of the front sinistral frame member and a portion of the front dextral frame member also contains a portion of the telescoping handle.

12. A golf ball retriever for releasably capturing a golf ball, comprising:

a telescoping handle;

a golf ball retrieving head connected to the telescoping handle and comprising a rigid frame, wherein the rigid frame consists of an elongated head that has a head length, a sinistral sides, a dextral side, a front, a back, a top, and a bottom;

wherein the rigid frame includes:

a front sinistral frame member and a front dextral frame member extending from the bottom to the top of the retrieving head, a front frame separation distance measured between the front sinistral frame member and the front dextral frame member, wherein the front frame separation distance is (a) greater than a golf ball diameter over a portion of the head length thereby defining an opening portion enabling the golf ball to enter the rigid frame, and (b) less than a golf ball diameter over a portion of the head length thereby defining a pocket portion in which the golf ball cannot exit the rigid frame, and wherein the front frame separation distance varies within the pocket portion;

a rear sinistral frame member and a rear dextral frame member extending from the bottom to the top of the retrieving head, a rear frame separation distance measured between the rear sinistral frame member and the rear dextral frame member, wherein the rear frame separation distance is less than the golf ball diameter throughout the head length, and the rear frame separation distance varies within the pocket portion;

a top sinistral frame member located at the top of the retrieving head and connecting the front sinistral frame member and the rear sinistral frame member, and a top dextral frame member located at the top of the retrieving head and connecting the front dextral frame member and the rear dextral frame member, wherein the top sinistral frame member and the top dextral frame member prevent the golf ball from exiting the top of the retrieving head;

a sinistral frame separation distance between the front sinistral frame member and the rear sinistral frame member, wherein the sinistral frame separation distance is less than the golf ball diameter throughout the head length and varies over a portion of the head length;

a dextral frame separation distance between the front dextral frame member and the rear dextral frame member, wherein the dextral frame separation distance is less than the golf ball diameter throughout the head length and varies over a portion of the head length; and at least a portion of the front sinistral frame member is angled toward the front dextral frame member as it extends toward the top within the pocket portion, and at least a portion of the front dextral frame member is angled toward the front sinistral frame member as it extends toward the top within the pocket portion.

13. The golf ball retriever of claim 12, wherein the sinistral frame separation distance varies within the pocket portion, and the dextral frame separation distance varies within the pocket portion.

14. The golf ball retriever of claim 13, wherein the front frame separation distance decreases continuously within the pocket portion, and the rear frame separation distance decreases continuously within the pocket portion.

15. The golf ball retriever of claim 14, wherein the sinistral frame separation distance varies within the opening portion, and the dextral frame separation distance varies within the opening portion.

16. The golf ball retriever of claim 15, wherein the opening portion extends throughout at least half of the head length.

17. The golf ball retriever of claim 15, wherein the top sinistral frame member and the top dextral frame member are formed in the shape of a semicircle having a diameter less than the golf ball diameter.

18. The golf ball retriever of claim 15, wherein the rear sinistral frame member contacts the rear dextral frame member within the pocket portion.

19. The golf ball retriever of claim 15, wherein a front plane containing a portion of the front sinistral frame member and a portion of the front dextral frame member also contains a portion of the telescoping handle.

20. A golf ball retriever for releasably capturing a golf ball, comprising:

a telescoping handle;

a golf ball retrieving head connected to the telescoping handle and comprising a rigid frame, wherein the rigid frame consists of an elongated head that has a head length, a sinistral sides, a dextral side, a front, a back, a top, and a bottom;

wherein the rigid frame includes:

a front sinistral frame member and a front dextral frame member extending from the bottom to the top of the retrieving head, a front frame separation distance measured between the front sinistral frame member and the front dextral frame member, wherein the front frame separation distance is (a) greater than a golf ball diameter over a portion of the head length thereby defining an opening portion enabling the golf ball to enter the rigid frame, and (b) less than a golf ball diameter over a portion of the head length thereby defining a pocket portion in which the golf ball cannot exit the rigid frame, and wherein the front frame separation distance varies within the pocket portion, and the opening portion extends throughout at least half of the head length;

a rear sinistral frame member and a rear dextral frame member extending from the bottom to the top of the retrieving head, a rear frame separation distance measured between the rear sinistral frame member and the rear dextral frame member, wherein the rear frame separation distance is less than the golf ball diameter throughout the head length, and the rear frame separation distance varies within the pocket portion;

a top sinistral frame member located at the top of the retrieving head and connecting the front sinistral frame member and the rear sinistral frame member, and a top dextral frame member located at the top of the retrieving head and connecting the front dextral frame member and the rear dextral frame member, wherein the top sinistral frame member and the top dextral frame member are curved and prevent the golf ball from exiting the top of the retrieving head;

a sinistral frame separation distance between the front sinistral frame member and the rear sinistral frame member, wherein the sinistral frame separation distance is less than the golf ball diameter throughout the head length and varies within the pocket portion;

a dextral frame separation distance between the front dextral frame member and the rear dextral frame member, wherein the dextral frame separation distance is less than the golf ball diameter throughout the head length and varies within the pocket portion; and at least a portion of the front sinistral frame member is angled toward the front dextral frame member as it extends toward the top within the pocket portion, and at least a portion of the front dextral frame member is angled toward the front sinistral frame member as it extends toward the top within the pocket portion.

* * * * *